US006296046B1

(12) United States Patent
Jeong et al.

(10) Patent No.: US 6,296,046 B1
(45) Date of Patent: Oct. 2, 2001

(54) EDGE DAM POSITION CONTROL METHOD AND DEVICE IN TWIN ROLL STRIP CASTING PROCESS

(75) Inventors: Seong In Jeong; Dong Koon Kim; Je Myeong Song, all of Kyungsangbook-do (KR)

(73) Assignees: Pohang Iron & Steel Co., Ltd.; Research Institute of Industrial Science & Technology, both of (KR)

( * ) Notice: Subject to any disclaimer, the term of this patent is extended or adjusted under 35 U.S.C. 154(b) by 0 days.

(21) Appl. No.: 09/367,901

(22) PCT Filed: Oct. 21, 1998

(86) PCT No.: PCT/KR98/00450

§ 371 Date: Aug. 19, 1999

§ 102(e) Date: Aug. 19, 1999

(87) PCT Pub. No.: WO99/32247

PCT Pub. Date: Jul. 1, 1999

(30) Foreign Application Priority Data

Dec. 20, 1997 (KR) ..... 97-71238

(51) Int. Cl.[7] ..... B22D 11/06; B22D 11/16

(52) U.S. Cl. ..... 164/452; 164/428; 164/480; 164/154.8

(58) Field of Search ..... 164/428, 480, 164/452, 483, 154.8

(56) References Cited

U.S. PATENT DOCUMENTS 4,811,780 * 3/1989 Yamauchi et al. ..... 164/428
5,052,467 * 10/1991 Tanaka et al. ..... 164/452
5,060,714 * 10/1991 Yamauchi et al. ..... 164/428
5,201,362 * 4/1993 Yamagami et al. ..... 164/480
5,628,359 5/1997 Legrand et al. ..... 164/428
5,638,892 * 6/1997 Barbe et al. ..... 164/452
5,706,882 * 1/1998 Fellus et al. ..... 164/452
5,927,375 * 7/1999 Damasse et al. ..... 164/451
6,079,480 * 6/2000 Oka et al. ..... 164/452

FOREIGN PATENT DOCUMENTS 4046656 2/1992 (JP) .
6015414 1/1994 (JP) .
7290205 11/1995 (JP) .

* cited by examiner

*Primary Examiner*—Tom Dunn
*Assistant Examiner*—Kevin P. Kerns
(74) *Attorney, Agent, or Firm*—Webb Ziesenheim Logsdon Orkin & Hanson, P.C.

(57) ABSTRACT

An edge dam position control method and device in a twin roll strip casting process calculates the reduction ratio and rolling force of rolls to obtain the height of a solidification point, and adjusting the height of an edge dam during casting to correspond to the obtained height of the solidification point. It minimizes the force applied to the edge dam during casting, reduces the degree of wear of the edge dam, and improves the quality of edge portions of both sides of the strip. This new method includes the following steps: calculating the position of a solidification point to a rolling force of twin rolls and diagrammatizing the calculated result; measuring a real rolling force of the twin rolls upon casting by means of a load cell; determining whether the position of the solidification point to the measured rolling force of the twin rolls corresponds to the current height of the edge dam; and moving the edge dam to a position where the height of the edge dam corresponds to the position of the solidification point to the measured rolling force of the rolls.

6 Claims, 16 Drawing Sheets

PRIOR ART

PRIOR ART

PRIOR ART

EDGE DAM POSITION CONTROL METHOD AND DEVICE IN TWIN ROLL STRIP CASTING PROCESS

BACKGROUND OF THE INVENTION

1. Field of the Invention

This invention relates to an edge dam position control device and method of controlling the upper and lower positions of an edge dam, which is installed on both edge faces of twin rolls in a twin roll strip casting process that produces a strip(hot coil) directly in melt, without having a process of producing slab. More particularly, this invention helps minimize the force applied to the edge dam during the casting, minimize the wear and tear of the edge dam and improve the quality of both end faces of a strip, by calculating the height of the solidification point using the roll reduction ratio and the roll reduction force, and adjusting the height of the edge dam in the casting to correspond to the height of the solidification point.

2. Discussion of Related Art

Referring to FIGS. 1 and 2, the strip casting method in a conventional twin roll strip casting device will be discussed. First, melt 207 is received within a ladle 200 and flows to a tundish 210 through a nozzle 205. Then, the melt 207 goes down to the space between a pair of rolls 220 and edge dams 230 that are mounted on the end faces of the pair of rolls 220. Next, the melt 207 is solidified on the surface of the rolls 220 rotating in opposite directions. The solidified shells 227 meet each other at the solidification point, which is generally above the roll nip point, which is a roll kissing point. Hence, the solidified shell is hot rolled at this stage.

Then, the cast strip 240 through the roll nip point passes through a cooling process and is coiled by a coiling system (not shown). In the above process, the thickness of the strip 240 is adjusted in accordance with the control of the interval between the rolls 220, and an adequate reduction of the solidified shell 227 is performed by means of a rolling force control unit 235, which is comprised of the roll assembly, hydraulic systems and control system. In this case, the rolling force of the rolls 220 can be measured by the load cell, which is connected to the cylinder rod 237*b* supporting a roll chock 220*a*.

Hence, in the twin roll strip casting process that directly casts the strip 240 with about 10 mm or less thickness from the melt 207, what is important is that the melt 207 should be properly infused into the space between the water cooled twin rolls 220 through the nozzle 225 from the tundish 210, so that the strip 240 can be produced with the desired thickness.

As shown in FIG. 1, in the conventional edge dam position control method, the bottom of the edge dams 230 is located on a roll nip point 222. Japanese Laid Open Application No. 4-46656 discloses a structure to support the edge dam 230 with a predetermined force using a hydraulic device against both end faces of the rolls 220.

In the above prior art, however, it is noted that upon a casting operation, the edge dam 230 is moved backward in a horizontal direction(in a vertical direction to the sheet of FIG. 1) due to the rolling force of the rolls 220 or the formation of skull(not shown) on a pool of the melt 207. Skull is a solidified slab which is formed by local solidification at the circumference of a nozzle on the melt pool surface or at the joint between an edge dam and molten metal. In this case, the force applied to the edge dam 230 is maintained at a constant state by means of the hydraulic device. In general, a main object of the edge dam is to prevent the leakage of the melt 207 from the both sides of the rolls 220. But in this case, the main object of edge dam cannot be achieved. Thus, good quality of the edge of the strip 240 may not be obtained.

In detail, when the edge dam 230 is moved backward due to the rolling force of the rolls 220 or the formation of the skull on the pool of melt 207, the melt 207 has a leakage through a crevice. This results in an irregular formation of edge flash on both edge faces of the strip 240, deteriorating the quality of the strip 240. When the solidified shell is inserted between the edge dam 230 and the rolls 220, the edge dam 230 and the twin rolls 220 are extremely damaged. Moreover, when the edge dam 230 is supported by a constant force against the rolls 220, a serious problem occurs because the edge dam 230 or the rolls 220 are extremely damaged on the side.

SUMMARY OF THE INVENTION

Accordingly, the object of this invention is to provide an improved position control method and device of an edge dam in a twin roll strip casting process, which can minimize the force applied to an edge dam during casting and can reduce the degree of abrasion of the edge dam.

Another object of the invention is to provide an edge dam position control method and device in a twin roll strip casting process. This can efficiently prevent a leakage of melt because an edge dam is not moved backward even by the application of a slight force, thereby ensuring the quality of strip.

According to an aspect of the present invention, there is provided an edge dam position control method in a twin roll strip casting process for controlling the position of an edge dam to improve the quality of strip, said method including the steps of: calculating the position of a solidification point to the rolling force of the rolls and the calculated result; measuring a real rolling force of the rolls upon casting by means of a load cell; determining whether the position of the solidification point to the measured rolling force of the rolls corresponds to the current height of the edge dam; and moving the edge dam to a position where the height of the edge dam corresponds to the position of the solidification point of the measured rolling force of the rolls.

According to another aspect of the present invention, there is provided an edge dam position control device for improving the quality of the strip by controlling the edge dam position in the twin roll strip casting process that casts strip from melt between the rolls, being equipped with a pair of cast rolls and the edge dams on both sides of the rolls, said device comprising:

an edge dam horizontal control unit having a firs. hydraulic cylinder which is adapted to be connected with the edge dam installed on both end faces of the rolls, respectively, to thereby allow the edge dam to maintain a predetermined force on the edge portions of both sides of the rolls, respectively, and having a horizontal position measuring sensor for measuring a horizontal displacement of the edge dam;

an edge dam vertical control unit disposed on the bottom surface of the edge dam horizontal control unit and having a second hydraulic cylinder which is adapted to ascend/descend the edge dam horizontal control unit and a vertical position measuring sensor to measure a vertical displacement of the edge dam to thereby control the upper and lower movement of the edge dam;

a first load cell for measuring the force of the edge dam which is exerted by the casting;

a second load cell for measuring the rolling force of the rolls applied to the strip which is exerted by the casting and hot rolling; and a controller For moving the edge dam by using the edge dam vertical control unit to a position where the height of the edge dam corresponds to the position of the solidification point of a pool of melt calculated on the basis of the rolling force of the rolls measured by the second load cell.

BRIEF DESCRIPTION OF THE DRAWINGS

Drawings are included herewith to promote further understanding of the invention, constitute a part of this specification, illustrate embodiments of the invention, and, along with the description, explain the principles of the drawings.

in the drawings:

FIGS. 4A and 4B are schematic views illustrating first and second embodiments of the edge dam position control device of FIG. 3, in which FIG. 4A shows the first embodiment when two hydraulic cylinders are disposed in an edge dam vertical position control unit, and FIG. 4B shows the second embodiment when a single hydraulic cylinder is disposed therein;

FIG. 13A shows the edge shape thereof fabricated in accordance with the conventional device and FIG. 13B shows the one thereof fabricated according to this invention.

DETAILED DESCRIPTION OF PREFERRED EMBODIMENTS

Reference will now be made in detail to the preferred embodiments of this invention. Examples are illustrated in the accompanied drawings.

Figure 1:
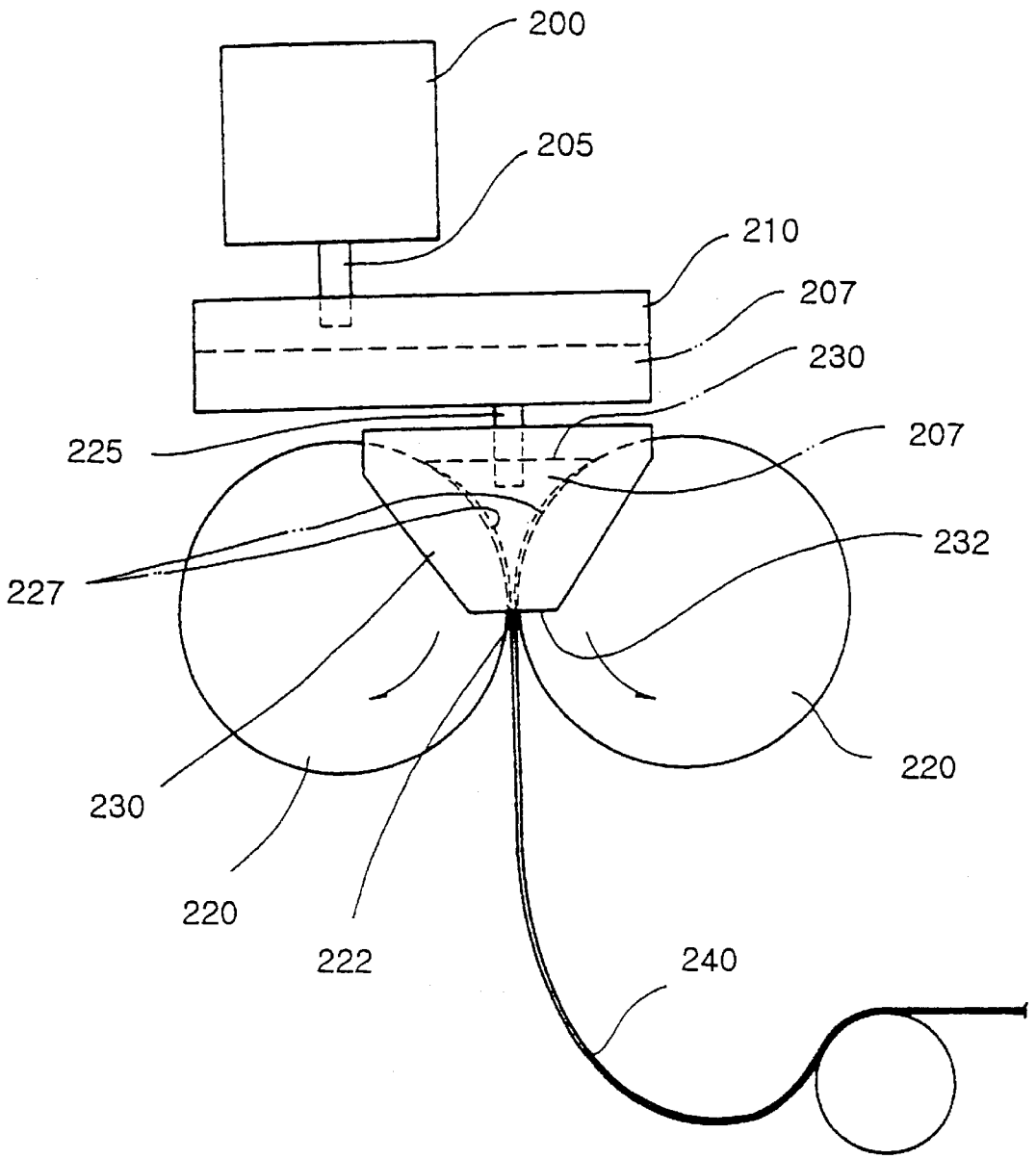
FIG. 1 is a schematic view illustrating the conventional twin roll strip casting device.
Figure 2:
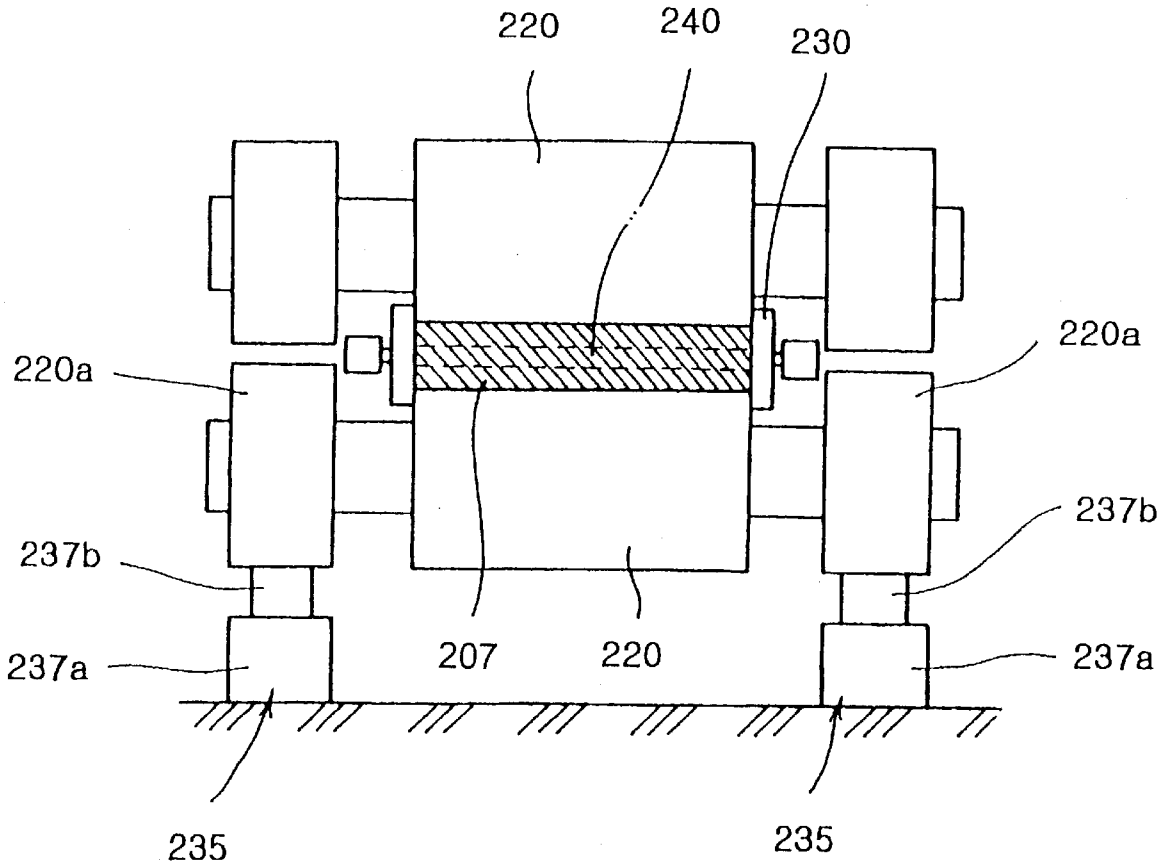
FIG. 2 is a plan view of the twin roll strip casting device of FIG. 1.
Figure 3:
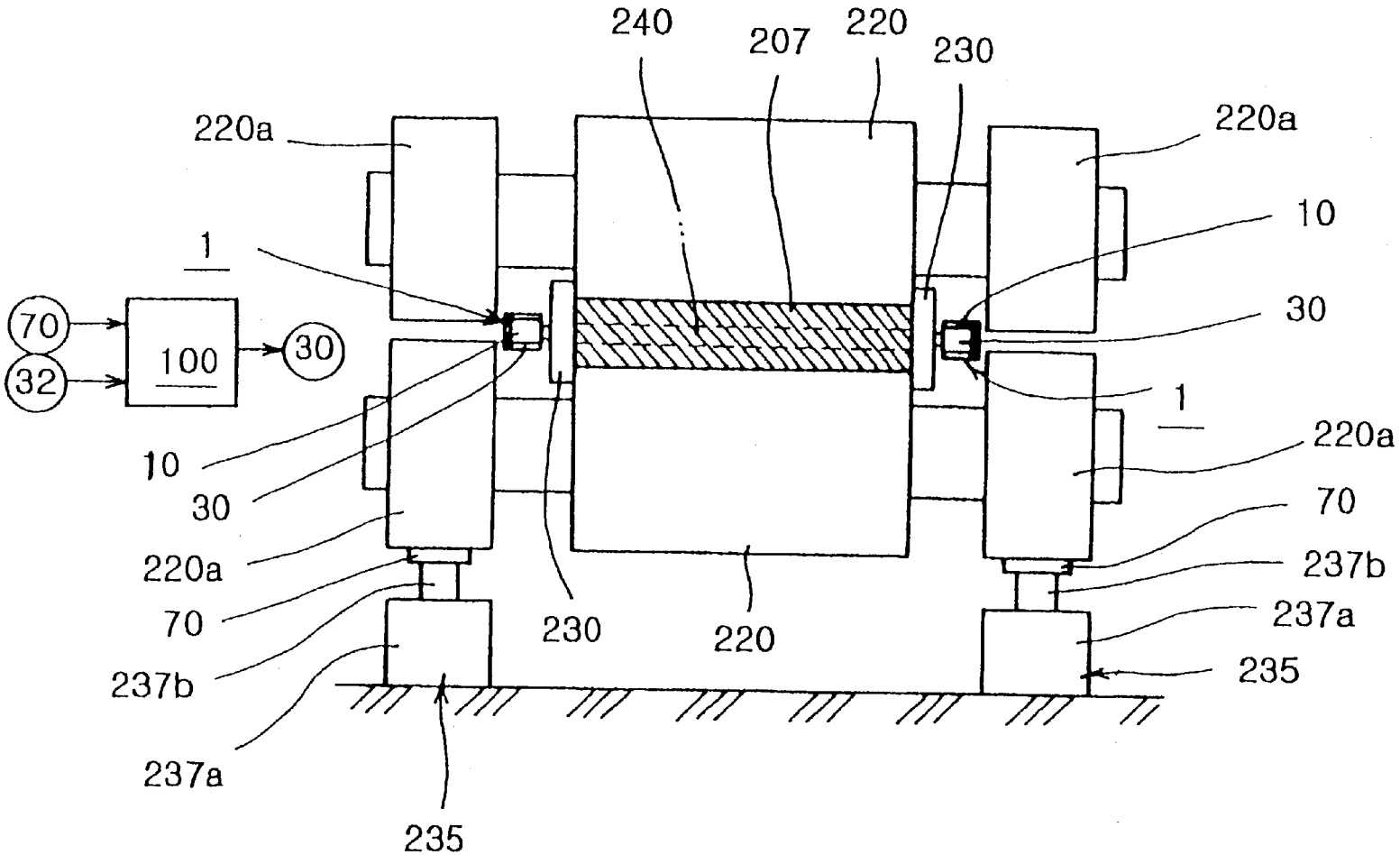
FIG. 3 is a schematic view illustrating an edge dam position control device according to this invention.
Figure 4A:
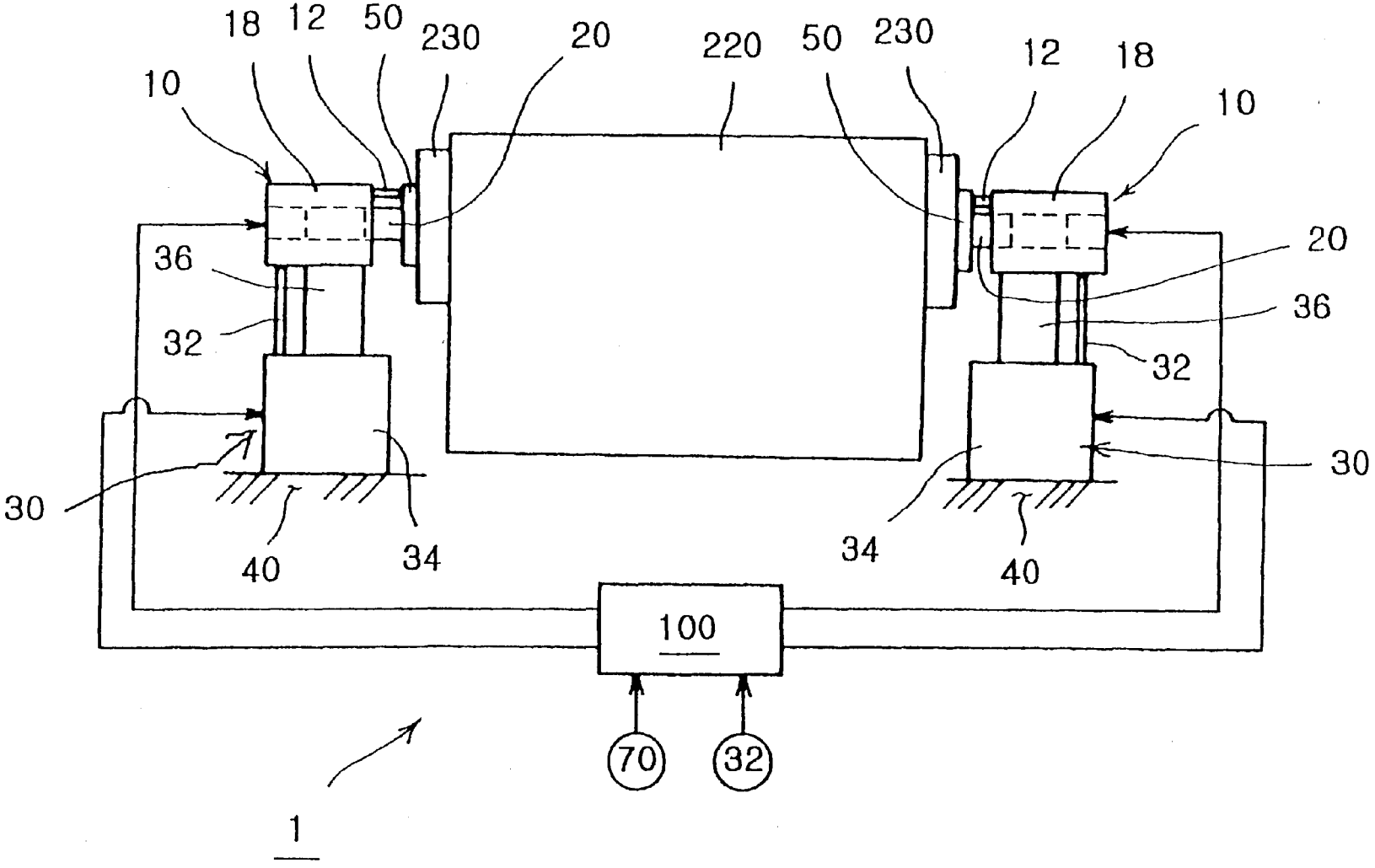
Figure 4B:
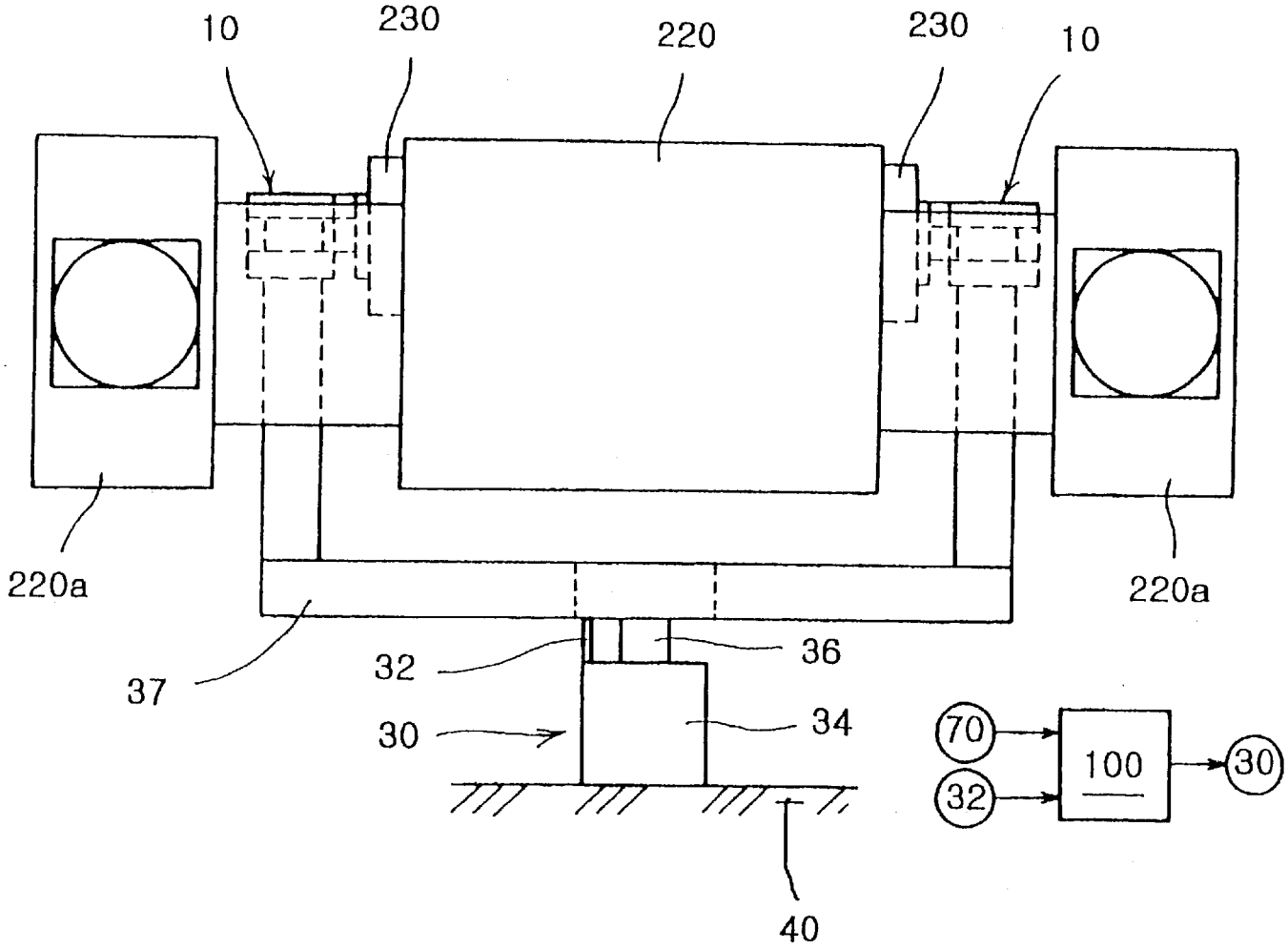
Figure 5:
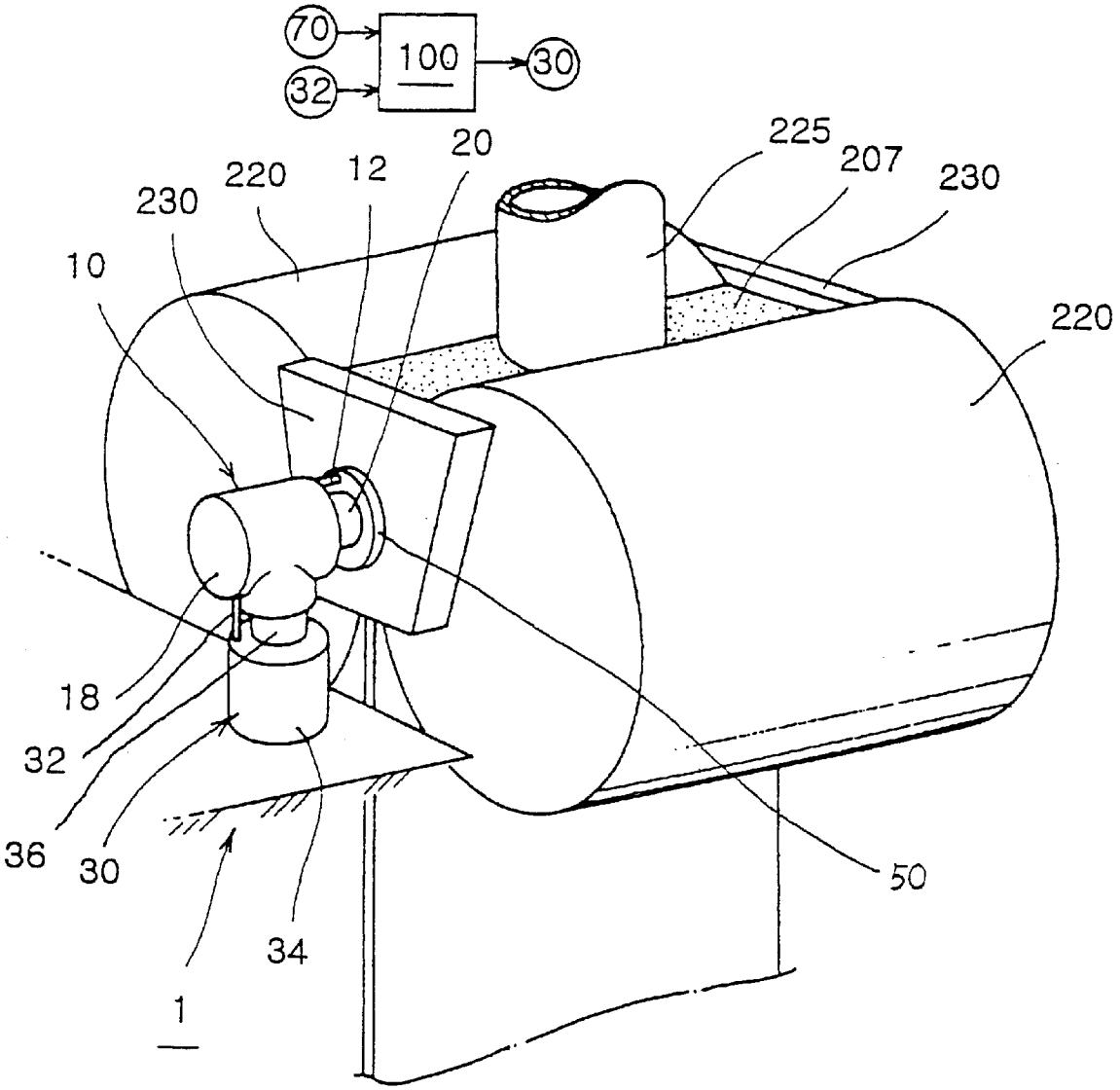
FIG. 5 is a perspective view of the edge dam position control device of FIG. 3.

FIG. 3 is a schematic view illustrating an edge dam position control device according to this invention, FIGS. 4A and 4B are schematic views illustrating first and second embodiments of the edge dam position control device of FIG. 3, and FIG. 5 is a perspective view of the edge dam position control device of FIG. 3.

As shown in FIGS. 3 and 5, the edge dam position control device 1 is comprised of an edge dam horizontal control unit 10 for applying a force in a horizontal direction to an edge dam 230 positioned on both end faces of twin rolls 220, respectively; an edge dam vertical control unit 30 having a position measuring sensor 32 to control the position of the edge dam 230 in a vertical direction and a hydraulic cylinder 34 to adjust the height of the edge dam 230; and first and second load cells 50 and 70 for measuring the rolling force of the rolls 220 and the applied force to the edge dam 230.

In the embodiment of the present invention, as shown in FIG. 4A, the hydraulic cylinder 34 of the edge dam vertical control unit 30 is mounted on the bottom of the edge dam horizontal control unit, respectively. Thus, the hydraulic cylinders 34 ascend and/or descend in the edge dams 230, independent from each other. To the contrary, as shown in FIG. 4B, a single hydraulic cylinder 34 of the edge dam vertical control unit 30 is mounted on a coupling frame 37. Thus, the hydraulic cylinder 34 can rise or fall in the edge dams 230 at the same time. It is of course considered that such variations of this invention are involved within the scope of this invention.

FIG. 5 shows the schematized view in which the hydraulic cylinder 34 of the edge dam vertical control unit 30 is mounted on the edge dams 230, respectively. Thus, the hydraulic cylinders 34 can change the positions in the edge dams 230, independent from each other. Hereinafter, an explanation of the structure of FIG. 5 will be discussed in detail. What should be kept in mind is that the operational principles of the structure of FIG. 5 is identical to that of FIG. 4B.

In this figure, the edge dam horizontal control unit 10 is adapted to apply a horizontal force to the edge dam 230. Thus, both end faces of the rolls 220 for sealing the melt are supported. The force applied by the edge dam horizontal control unit 10 and the displacement of the edge dam 230 are detected by the first load cell 50 and a horizontal position measuring sensor 12. The detected result is transmitted as an electrical signal to a controller 100. This will be discussed later on. The edge dam horizontal control unit 10 serves to support the edge dam 230. Thus the edge dam 230 is not pushed from both sides of the casting rolls 220 during the casting.

Figure 6:
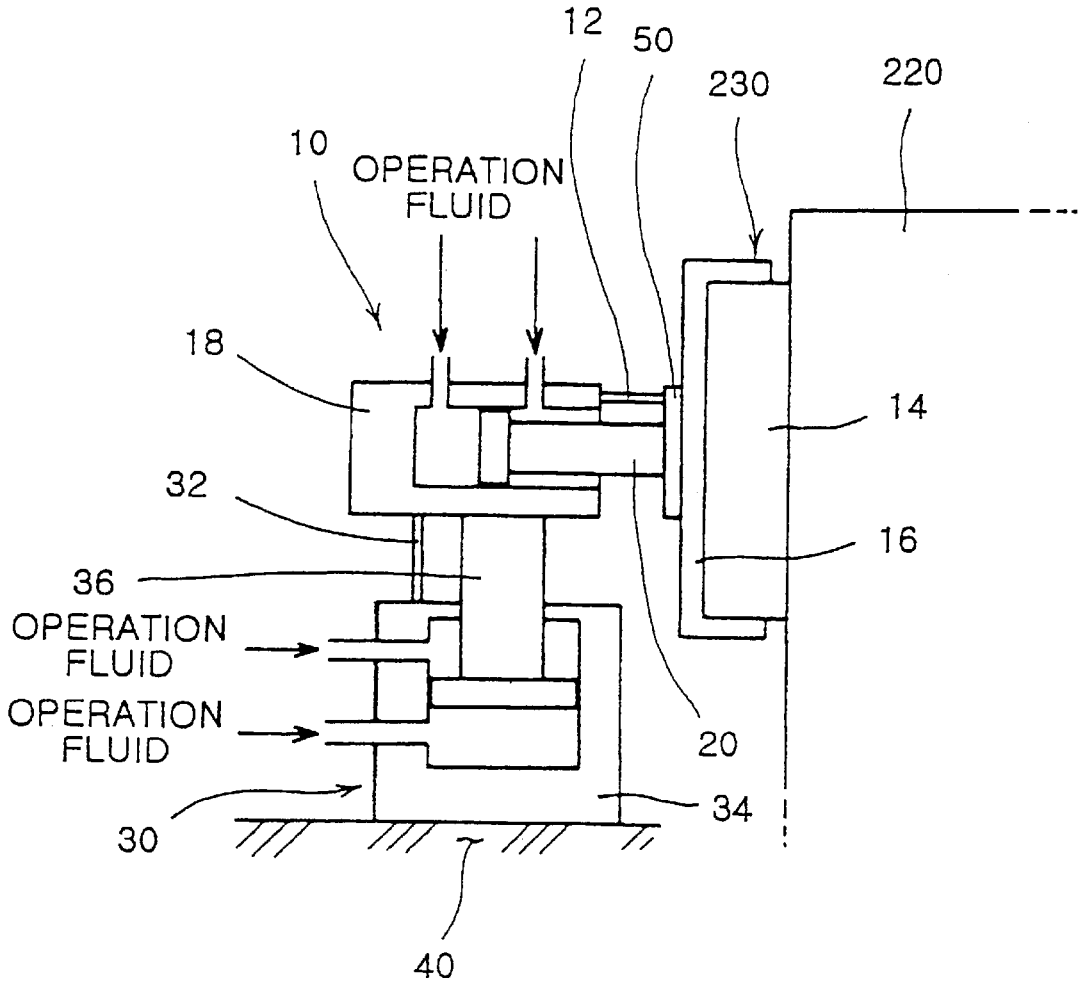
FIG. 6 is a detailed side view of the edge dam position control device of FIG. 3.

In addition, as shown in FIG. 6, the edge dam horizontal control unit 10 is adapted to connect an edge dam cassette 16, which covers a refractory body 14 of the edge dam 230 with a cylinder rod 20 of the horizontal hydraulic cylinder 18. As a result, the cylinder rod 20 applies the horizontal force to the edge dam 230 in accordance with the inflow/outflow of the fluid supplied to the horizontal hydraulic cylinder 18. Thus the edge dam 230 is pushed on the end faces of the casting rolls 220 and seals the melt. Also, the load cell 50 is equipped on the front or rear surface of the cylinder rod 20 to measure the force applied to the edge dam 230.

As known, the control method of the edge dam 230 in the horizontal direction is divided into two categories; one is a constant position control method, the other is a constant load control method. The former is controlled the load or pressure of the edge dam to maintain the preset position of the edge dam, the latter, that is the constant load control method, consists of the edge dam to maintain the preset load of the edge dam. In this case, both the position and the load control method can be utilized.

On the other hand, the edge dam vertical control unit 30 is mounted to control the height $H_E$ of edge dam 230 in a vertical direction and goes up and down through a vertical hydraulic cylinder 34. The edge dam vertical control unit 30 is comprised of the vertical hydraulic cylinder 34 and a vertical position measuring sensor 32 which is adapted to measure the vertical displacement of the edge dam 230. The cylinder rod 36 of the vertical hydraulic cylinder 34 is connected to the bottom portion of the edge dam horizontal control unit 10, to thereby vertically move the edge dam 230. Here, the vertical hydraulic cylinder 34 is mounted on the bottom of the supporting structure 40.

The edge dam vertical position measuring sensor 32 is mounted on the hydraulic cylinder 34 and continuously measures a distance in a vertical direction up to the hydraulic cylinder 18 of the edge dam horizontal control unit 10 to thereby obtain the height $H_E$ of the edge dam 230. Then, the measured height as an electrical signal is transmitted to the controller 100.

In the meantime, the load cell 70 as shown in FIG. 3 is adapted to measure the rolling force applied to the hot strip 240. The rolls 220 are disposed in the horizontal direction and a roll chock 220*a* with bearing(not shown) is connected to both end faces of the shafts of the rolls 220, respectively. Therefore, even though the rolls 220 rotate, the roll chock 220*a* is not rotated. Also, the roll chock 220*a* is connected to a hydraulic cylinder rod 237*b* of a rolling force control unit 235, to thereby support the rolls. The load cell 70 is mounted on the front or rear surface of the hydraulic cylinder 237*a*. If the roll rolling force control unit 235 controls the position of: the roll chock 220*a* and thus enables the rolls 220 to pressurize the strip 240, the roll separation force of the rolls 220 is measured in the load cell 70.

Then, the load cell 70 transmits the measured value as an electrical signal to the controller 100.

Figure 7:
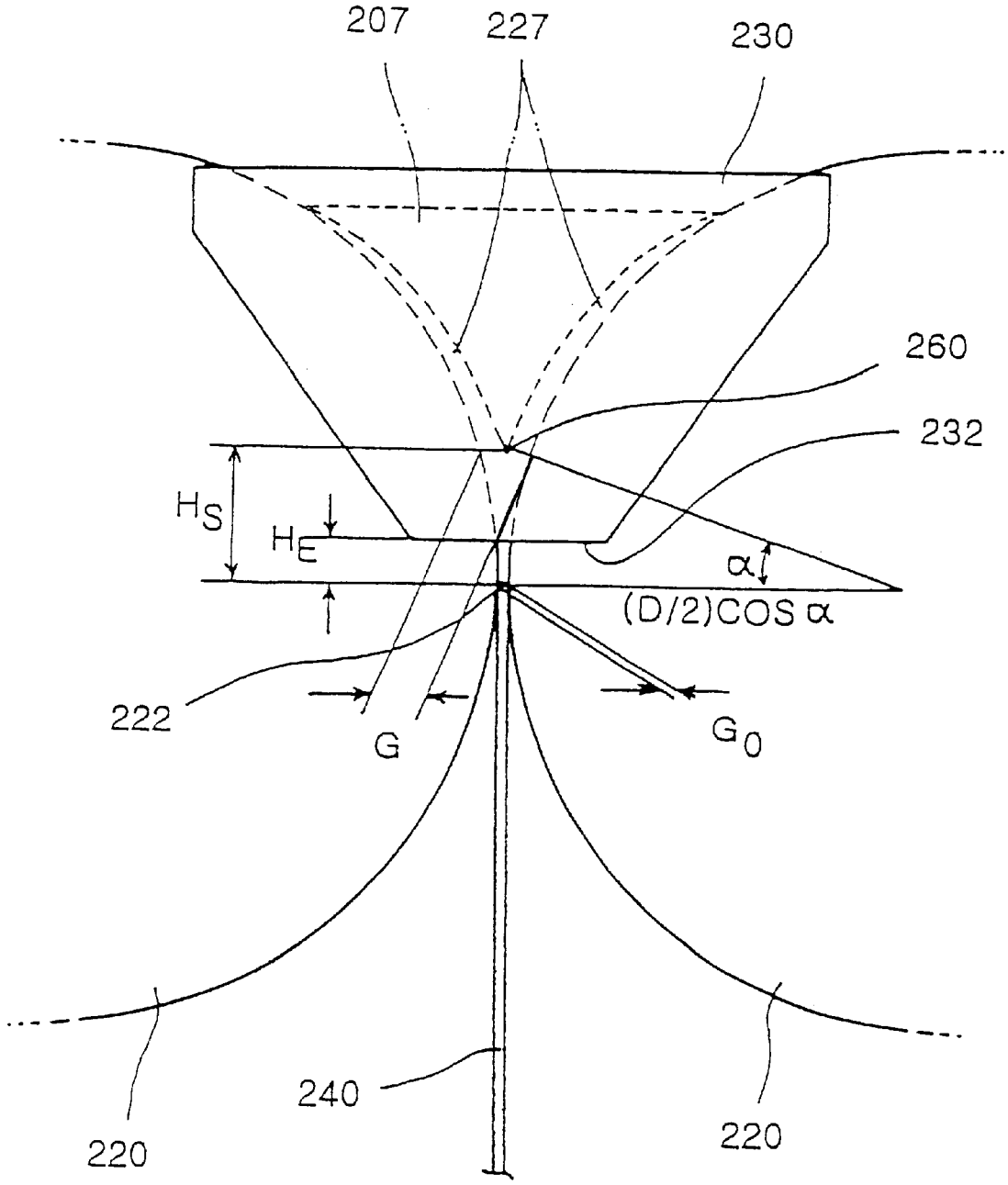
FIG. 7 is a schematic view illustrating the height of an edge dam and the height of the solidification point during the strip casting process in the edge dam position control device according to this invention.

Referring to FIG. 7, the roll separation force, that is, the rolling force by the rolls 220, is one of important variables of casting conditions, and is dependent upon a degree of growth of the solidified shell 227 from the melt 207. The height $H_s$ of the solidification point 260 is varied in accordance with the degree of the rolling force of the rolls 220. Therefore, when the rolling force is increased, the height $H_s$ of the solidification point 260 is upgraded. The hot deformed strip 240 applies a big force onto the surface of the edge dam 230 as the rolling force of the rolls 220 increases.

FIG. 7 shows the correlation between the height $H_E$ of the edge dam 230 and the height $H_s$ of the solidification point 260 during the strip casting process in the edge dam position control device 1 according to this invention. The melt 207 infused between the twin rolls 220 is solidified along with the surfaces of the rolls 220, and the solidified shells 227 on both surfaces of the rolls 220 by the solidification of the melt 207 meet each other at the solidification point 260. The distance G indicates that the gap between the rolls 220 at the solidification point 260 is larger than the distance $G_o$ which indicates a gap between the rolls 220 at a roll nip point 222, which is a roll kissing point, on which the rolls 220 are adjacent to each other. Therefore, the strip 240 should be reduced to escape from the roll nip position 222. At the time, the rolling force of the rolls 220 is changed in accordance with the height $H_s$ of solidification point 260, and the applied force to the edge dam 230 is changed.

Therefore, the height $H_s$ of the solidification point 260 is changed in accordance with the rolling force of the rolls 220 in the strip 240 having the same thickness and width.

The edge dam position control device 1 in the twin roll strip casting process according to this invention obtains the height $H_s$ of the solidification point 260 based upon the rolling force of the rolls 220 using the load cell 70 in a diagrammiatized manner. It also moves the edge dam 230 by using the edge dam vertical control unit 30 under the control of the controller 100 to a position where the height $H_E$ of the bottom of the edge dam corresponds to the height $H_s$ of the solidification point 260. The movement enables the minimization of the force applied to the edge dam 230 from the melt 207, thereby suppressing the damage or abrasion of the edge dam 230 and improving the durability of the edge dam 230. At the same time, it minimizes occurrences of the edge flash formed on both edges of the strip 240, thereby ensuring the quality of the strip 240.

In detail, in this invention, the bottom of the edge dam 230 during casting is positioned in the vicinity of the roll nip position 222 or an estimated height relative to a predetermined rolling force of the rolls 220. However, if the rolling force of the rolls 220 is increased and applied to the edge dam 230, the height $H_E$ of the bottom of the edge dam 230 will be moved to the height $H_s$ of the solidification point 260, thereby minimizing the applied force to the edge dam 230. As a result, the damage or abrasion of the edge dam 230 can be controlled and the durability of the edge dam 230 can be improved. Also, the edge flashes formed on both edge faces of the strip 240 can be minimized to obtain the quality of the strip 240.

Next, an edge dam position control method according to the present invention will be explained.

A primary object of the utilization of the edge dam 230 is to prevent a leakage of the melt 207, and to protect the edge dam 230. The edge dam 230 should be placed not at a position where the strip 240 is formed, after the melt 207 is cast and solidified, but at a position where the melt 207 exists. In other words, if the applied force to the edge dam 230 is generated during casting by solidification and rolling of melt, and is excessively delivered to the edge dam 230 under the casting conditions, there will be a problem that the edge dam 230 may be damaged or worn out. If the edge dam 230 cannot hold such excessive force due to the hot rolling of the strip 240, the edge dam 230 will be moved backward. Since the melt 207 is leaks, an equipment accident may occur or the quality of the strip 240 may be deteriorated.

Hence, when the rolling force is changed during casting or of the strip 240 is to be cast under a specific rolling force condition, the height $H_E$ of the edge dam 230 should be controlled in consideration of the rolling force of the rolls 220 and the height $H_s$ of the solidification point 260.

Figure 12A:
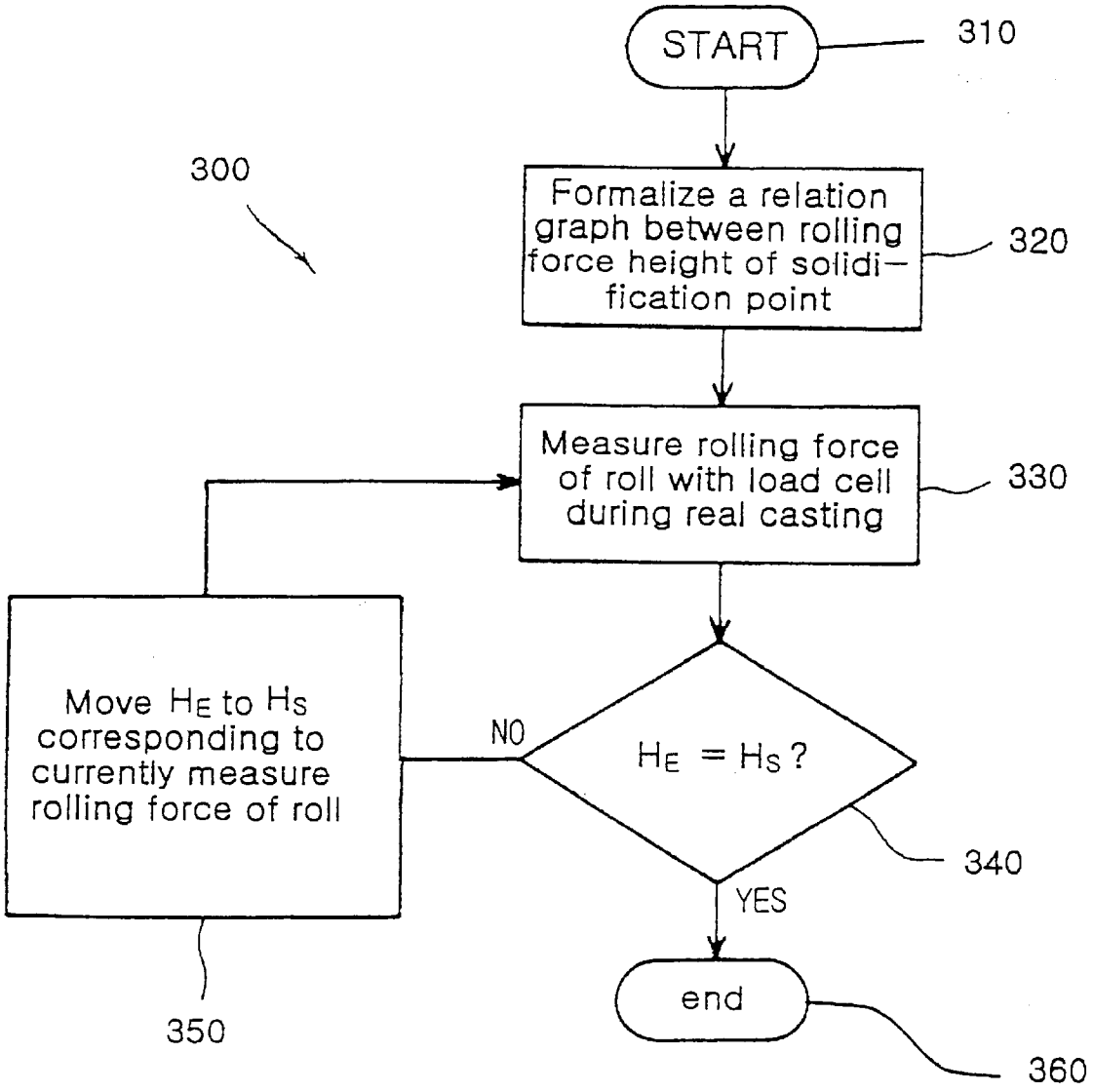
FIGS. 12A and 12B are flow charts illustrating an edge dam position control method according to this invention.
Figure 12B:
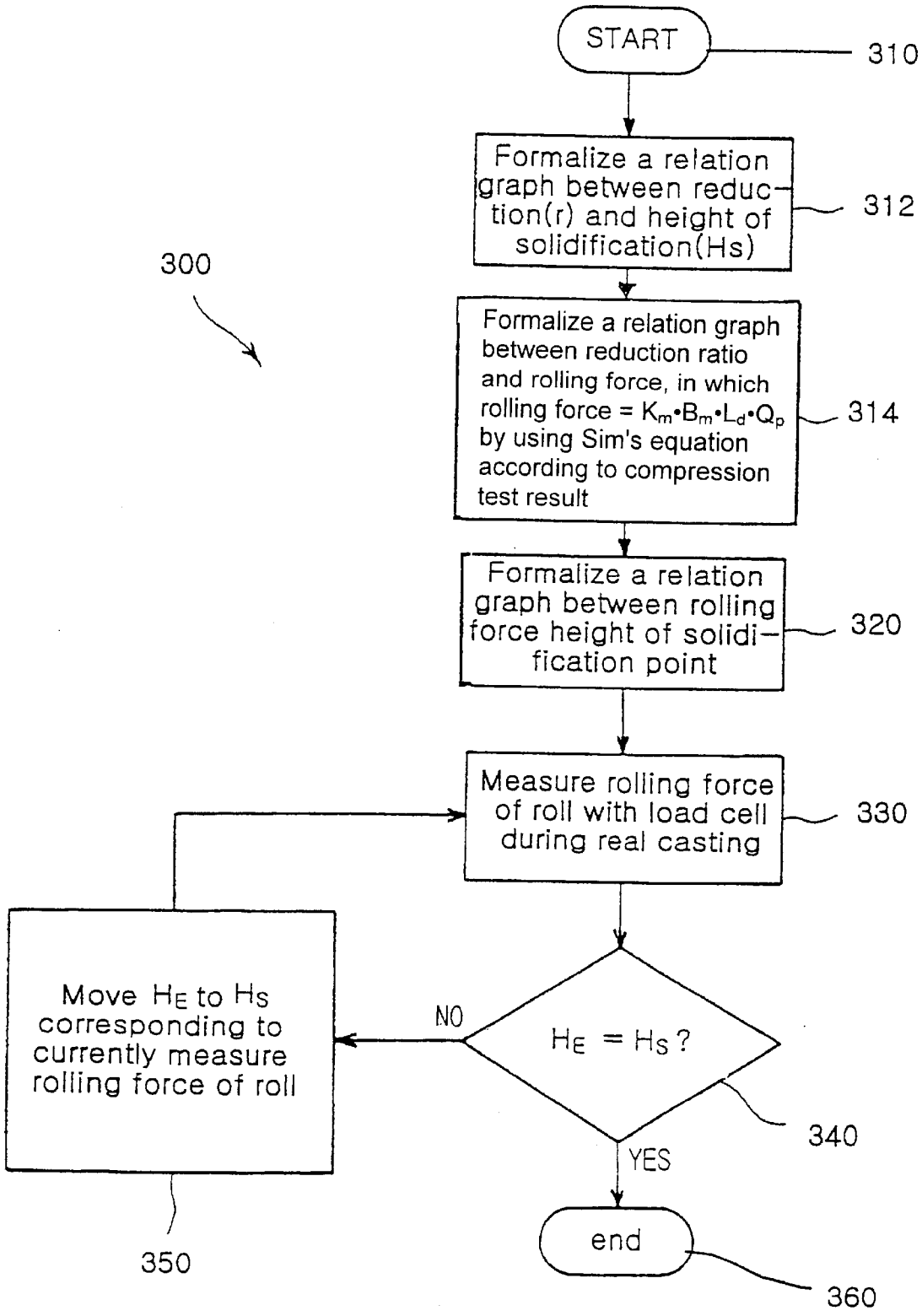

FIGS. 12A and 12B each show the relationship between the height of the solidification point 260 $H_s$ and the rolling force and the flow diagram or flow chart of the position control method of the edge dam 230.

An edge dam position control method 300 in a twin roll strip casting process in this invention improves the quality of the strip 240 by controlling the vertical position of the edge dam 230 in the twin roll strip casting process, which casts strips 240 from the rolls 220 in melt 207, being equipped with a pair of cast rolls 220 and the edge dams 230 on both end faces of the rolls.

As shown in FIG. 12A, the first step is step 310, the second step is step 320, which is calculating the position of the solidification point 260 to the rolling force of the rolls 220. As shown in FIG. 12B, the above step 320 is comprised of the steps of calculating the position of the solidification point 260 to the reduction ratio of the rolls 220 at step 312, and calculating the rolling force of the rolls 220 to the reduction ratio of the rolls 220 at step 314.

Figure 8:
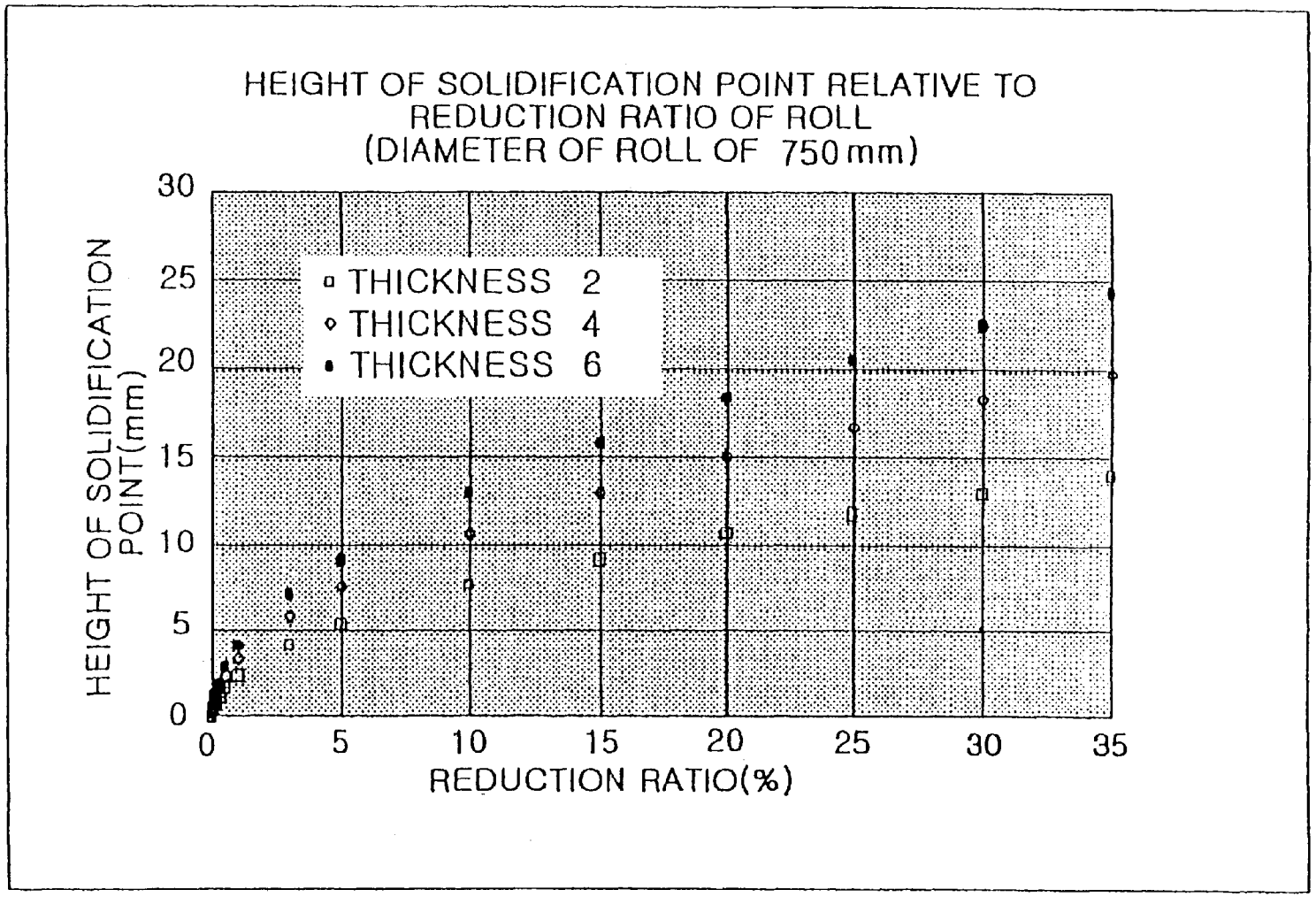
FIG. 8 is a graph illustrating the calculated result of the height of the solidification point of the reduction ratio of rolls in the edge dam, position control device according to this invention.
Figure 9:
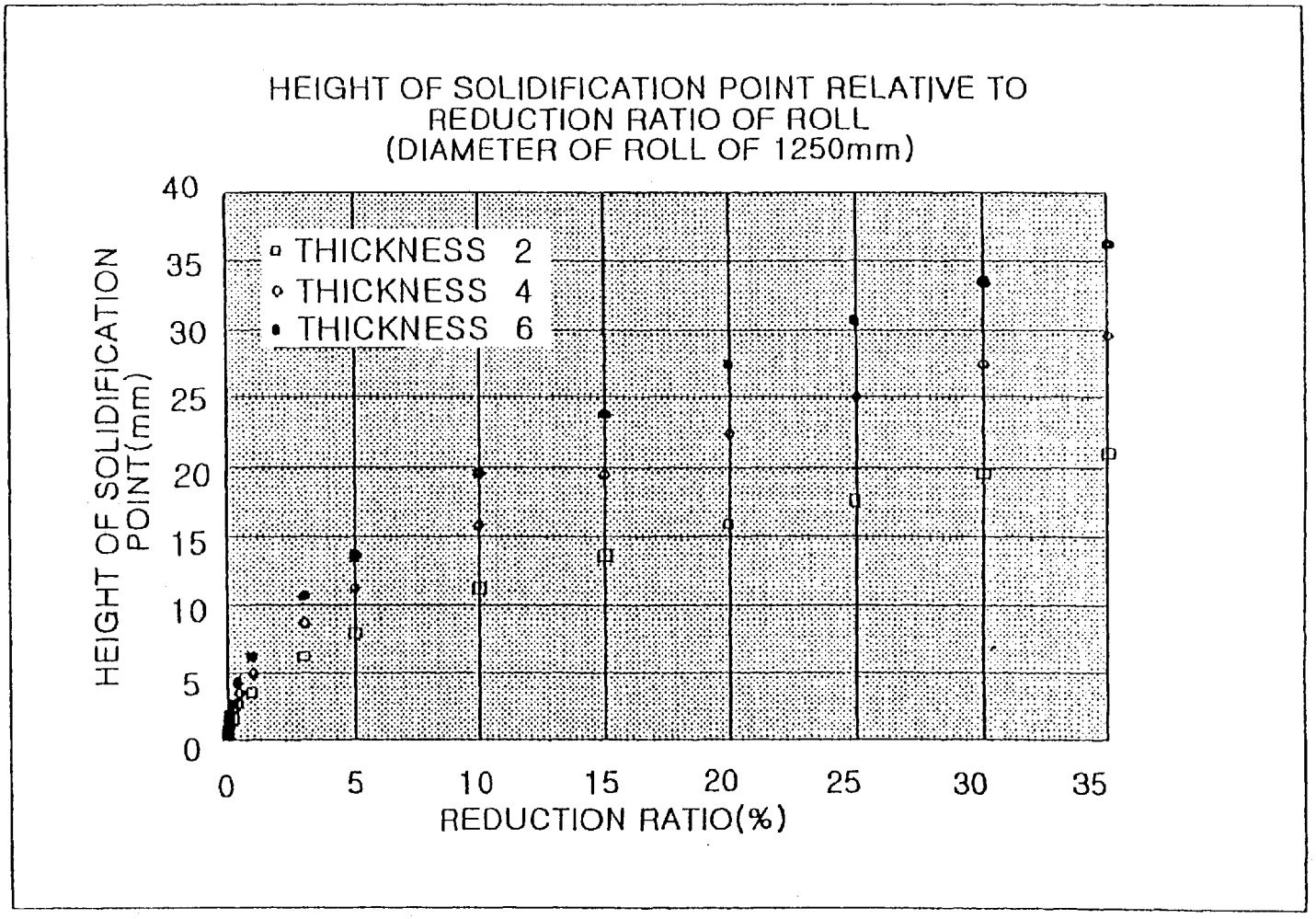
FIG. 9 is a graph illustrating the calculated result of the height of the solidification point to the reduction ratio of rolls in the edge dam position control device according to this invention.

Accordingly, the final object of the edge dam position control method in this invention is to obtain the position of the solidification point 260 to the rolling force of the rolls 220 by means of the load cell. To this end, the position of the solidification point 260 to the reduction ratio of the rolls 220 is obtained first, and the rolling force of the rolls 220 to the reduction ratio of the rolls 220 is obtained later. Based upon the above relationship, the position of the solidification point 260 to the rolling force o: the rolls 220 can be obtained. The reduction ratio can be expressed in a ratio of the distance G indicating the gap between the rolls 220 at the solidification point 260 to a difference of distance($G-G_o$) between the distance G and the distance $G_o$ indicating the gap between the rolls 220 at the roll nip point 222. This can be calculated geometrically in a simple manner. The calculated examples for two casters with different diameters of two rolls 220 are each shown in FIGS. 8 and 9. FIG. 8 shows the results with 750 mm, and FIG. 9 shows 1250 mm. The height $H_s$ of the solidification point 260 according to the reduction ratio of the rolls 220 can be obtained by the following numerical expressions (1) and (2):

$$\text{Reduction Ratio} = \frac{(G - G_o)}{G} \times 100 \tag{1}$$

$$G = G_o + D \times (1 - \cos\alpha),\ \alpha = \sin^{-1}\left(\frac{2 \times H_s}{D}\right) \tag{2}$$

In the twin roll strip casting device, the distance G indicating the gap between the rolls 220 at the solidification point 260 is obtained by the calculation of the above numerical expression (2). When the obtained distance G is substituted for the numerical expression (1), the reduction ratio, relative to the height of the solidification point 260, is obtained by the following numerical expression (3):

$$\text{Reduction Ratio} = \frac{D\left(1 - \cos \cdot \sin^{-1}\left(\frac{2H_s}{D}\right)\right)}{G_o + D\left(1 - \cos \cdot \sin^{-1}\left(\frac{2H_s}{D}\right)\right)} \times 100 \tag{3}$$

The reference character 'G' represents a gap between the rolls at the solidification point 260, '$G_o$' an initial gap between the rolls at the roll nip point 222, 'D' the diameter of the roll, '$H_s$' the height up to the solidification point 260 from the roll nip point 222, and '$\alpha$' an angle between the roll nip point 222 and the solidification point 260, based upon the center of the roll 220.

As shown in FIGS. 8 and 9, the position of the solidification point 260 is increased as the reduction ratio of the rolls 220 increases, and the solidification point 260 goes up as the diameter of the roll 220 widens.

It is of course important to find out the solidification point 260 in accordance with the reduction ratio of the rolls 220. Since the reduction ratio thereof is difficult to obtain during casting, however, in the embodiment of this invention, it will be desirable that the reduction ratio of the rolls 220 should be measured or indicated with the value which is readily recognized, that is the rolling force during the casting. To obtain the rolling force of the rolls 220 according to the reduction ratio of the rolls 220, therefore, the relationship of the rolling force of the rolls 220 to the reduction ratio of the rolls 220 is obtained at step 314.

At step 314, the relationship of the rolling, force of the rolls 220 to the reduction ratio of the rolls 220 is obtained under a hot deformation test, and by using the following Sim's Equation:

$$\text{Rolling Force} = K_m \cdot B_m \cdot L_a \cdot Q_p \tag{4}$$

The variable '$K_m$' designates mean hot deformation resistance(kg/mm$^2$), '$B_m$' mean strip width, '$L_d$' length(mm) of contact arc, and '$Q_p$' geometric factor.

$$L_d = \alpha \frac{D}{2} \tag{5}$$

$$Q_p = 0.8 + (0.45\gamma + 0.04)\sqrt{\frac{D}{2G} - 0.5} \tag{6}$$

$$\gamma = (G - G_o)/G = \text{strain} \tag{7}$$

$$K_m = f(C, \varepsilon, \dot{\varepsilon}, T) = C \cdot \varepsilon^n, \dot{\varepsilon}^m \cdot \exp\left(\frac{A}{T}\right) \tag{8}$$

The variable 'C' represents composition, the '$\epsilon$' strain, the '$\dot{\epsilon}$' strain ratio, and 'T' temperature(°K.).

In case of stainless steel 304, in a general hot rolling process, C=0.24, n=0.07, m=0.05 and A=5700, and in a strip continuous casting, C=0.2, n=0.07, m=0.05 and A=5300.

The strain in the expression (7) is equal to the reduction ratio of the rolls 220, but there is only a difference in that the reduction ratio of the rolls 220 is indicated by percentage. The strain rate is calculated with 3 sec$^{-1}$ in consideration of the case of casting twin roll strip, and the relationship between the rolling force of the rolls 220 and the reduction ratio of the rolls 220 is obtained by substituting the expressions (5) to (8) for the expression (4).

Figure 10:
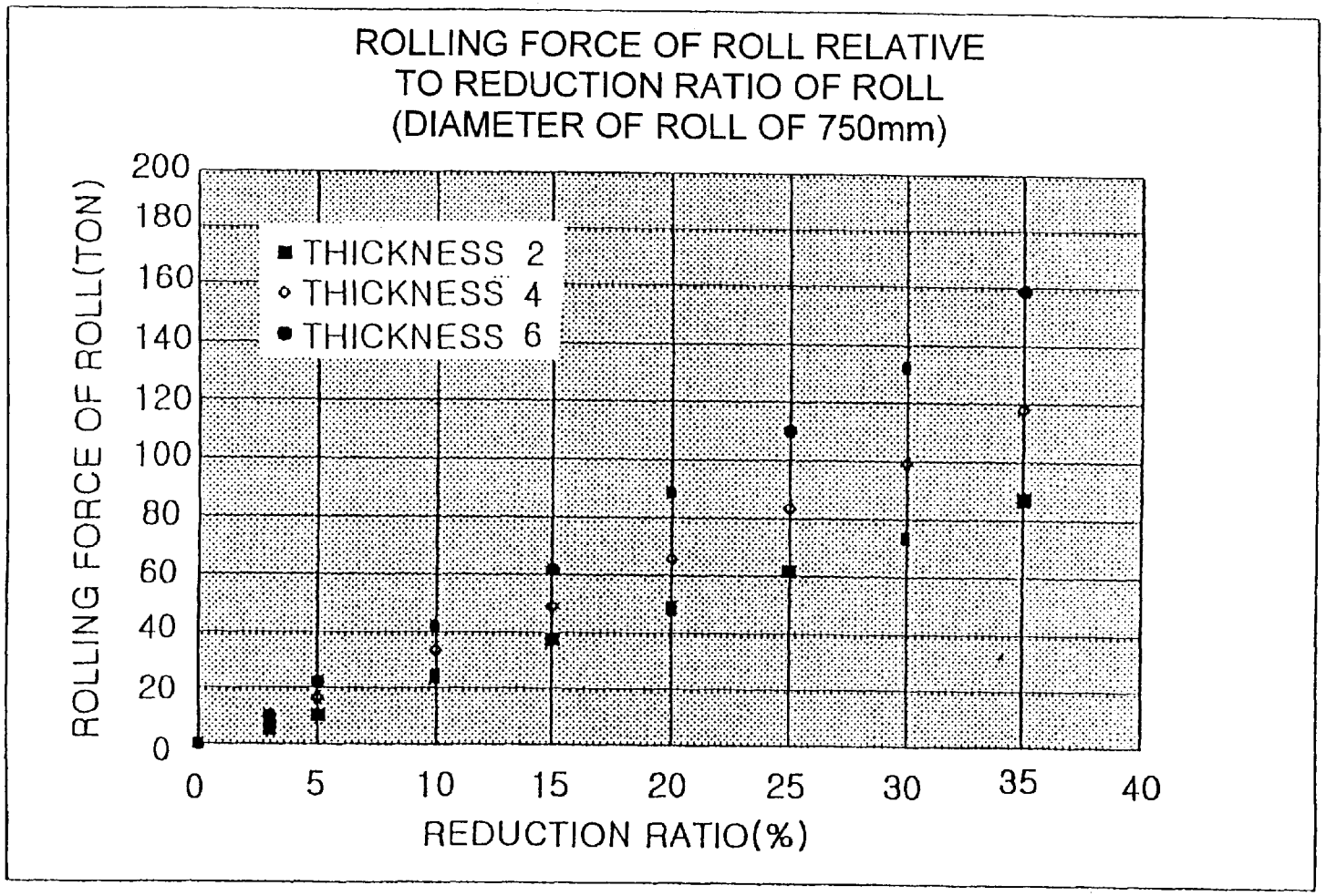
FIG. 10 is a graph illustrating the calculated result of the rolling force of rolls to the reduction ratio of the rolls In the edge dam position control device according to this invention.

FIG. 10 shows the calculated result of the rolling force of the rolls 220 to the reduction ratio of the rolls 220 in accordance with the thickness of the strip 240 and the diameters 0o the rolls 220. Also, FIG. 10 shows the calculated result in the case where each of the twin rolls 220 is made of a copper material, and a stainless steel is made of cast. In the calculation, assuming a temperature of about 1350° C., strip of about 350 mm in width, strip of about 4 mm in thickness, roll of about 750 mm in diameter and the strain rate of 3 sec$^{-1}$, in the expression (5–8) $K_m$=4.7 kg/mm$^2$, $B_m$=350 mm, $Q_p$=1.58 and $L_d$=12.9 mm. As a result, referring to FIG. 11, the rolling force of the rolls 220 is about 33.6 tons. At that time, the height $H_s$ of the solidification point 260 is about 13 mm.

Figure 11:
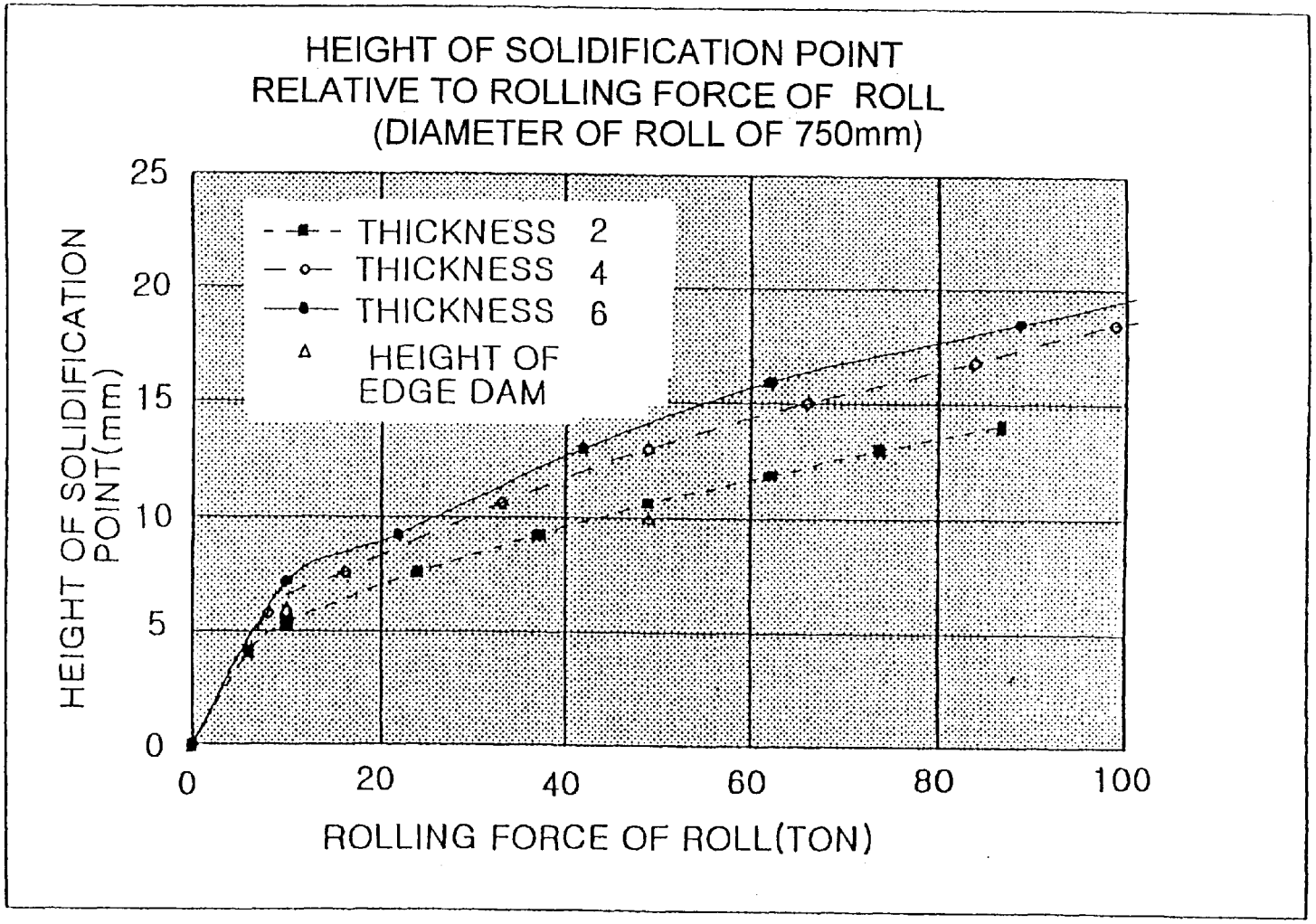
FIG. 11 is a graph illustrating the calculated results oft the height of the solidification point and the height of an edge dam to the rolling force of rolls in the edge dam position control device according to this invention.

Through the above steps, the height $H_s$ of solidification point 260 can be calculated with the rolling force of the rolls 220 which is easily measured during casting. In FIG. 11, the relationship between the rolling force of the rolls 220 and the height $H_s$ of solidification point 260 is obtained by calculation with the thickness of the strip 240 and the diameters of the rolls 220. As noted in FIG. 11, the height $H_s$ of the solidification point 260 increases as the rolling force of the rolls 220 increases.

As in FIG. 11, in case when the strip of about 4 mm thick is cast with the rolling force of the rolls 220 of about 20 tons, the height of the solidification point 260 Hs is about 8 mm. Hence, if the height $H_E$ of the bottom end of the edge dam 230 to the roll nip point 222 is maintained at the height of about 8 mm, the force applied to the edge dam 230 can be minimized. The force applied to the edge dam 230 is measured by means of the load cell 50 within the edge dam horizontal control unit 10 and is preferably controlled to be a proper value.

After the position of the solidification point 260 to the rolling force of the rolls 220 has been calculated at step 320, the next rolling force of the rolls 220 during casting is measured using the load cell 50 at step 330. In this case, the load cell 50 mounted on the rolling force control unit 235 continuously measures the rolling force of the rolls 220 applied to the strip 240 and provides the measured value to the controller 100.

Next, at step 340 it should be determined whether the calculated position of the solidification point 260 to the rolling force of the rolls 220 corresponds with the current height of the edge dam 230. If so, the controller 100 compares the height $H_s$ of solidification point 260, which is calculated to the rolling force of the rolls 220 in the correlation of the height of the solidification point 260 to the rolling force of the rolls 220 at step 320, with the height $H_E$ of the edge dam 230, which is transmitted as an electrical signal by the continuous measurement of the distance in the vertical direction up to the hydraulic cylinder 18 of the edge dam horizontal control unit 10. The vertical position measuring sensor 32 is used within the edge dam vertical control unit 30. At this step 340, the height $H_s$ of the solidification point 260 is equal to the height $H_E$ of edge dam 230, the edge dam position control operation will be completed at step 360. However, if not equal, at step 350 the edge dam 230 will be moved upward or downward to a position where the height $H_E$ of edge dam 230 corresponds with the height $H_s$ of the solidification point 260, by using the hydraulic cylinder 34 within the edge dam vertical control unit 30.

The edge dam position control method 300 in a twin roll strip casting process in this invention in which a pair of casting rolls 220 and a pair of edge dams 230 installed on both end faces of the rolls 220, are provided to cast a strip 240 between the rolls 220, includes the steps of: measuring a real rolling force of the rolls 220 to the strip 240 during casting; and moving the bottom of the edge dam 230 to the position of a solidification point 260 relative to the measured rolling force of the rolls 220.

Figure 13A:
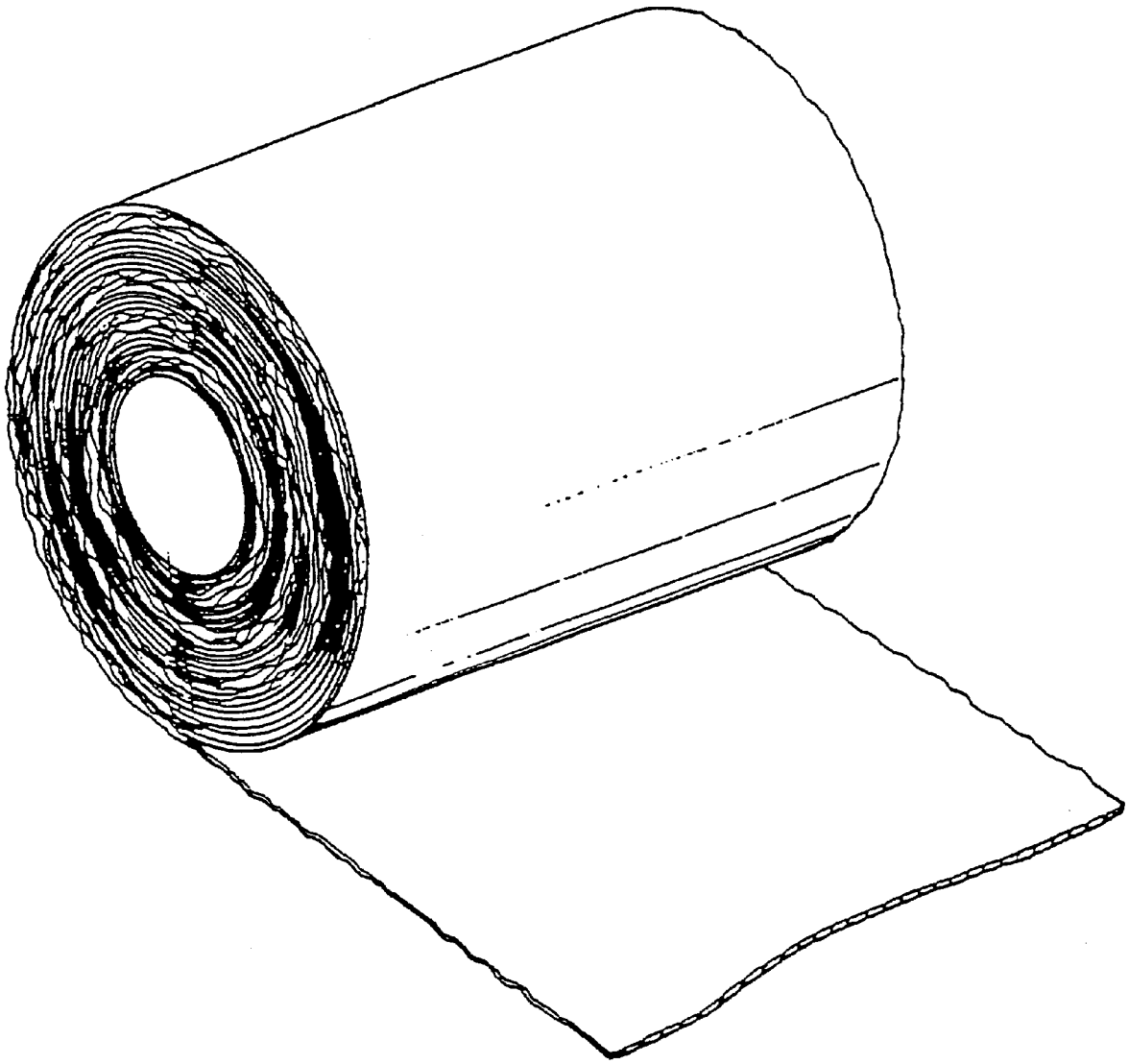
FIGS. 13A and 13B are views of the edge shape of a strip.
Figure 13B:
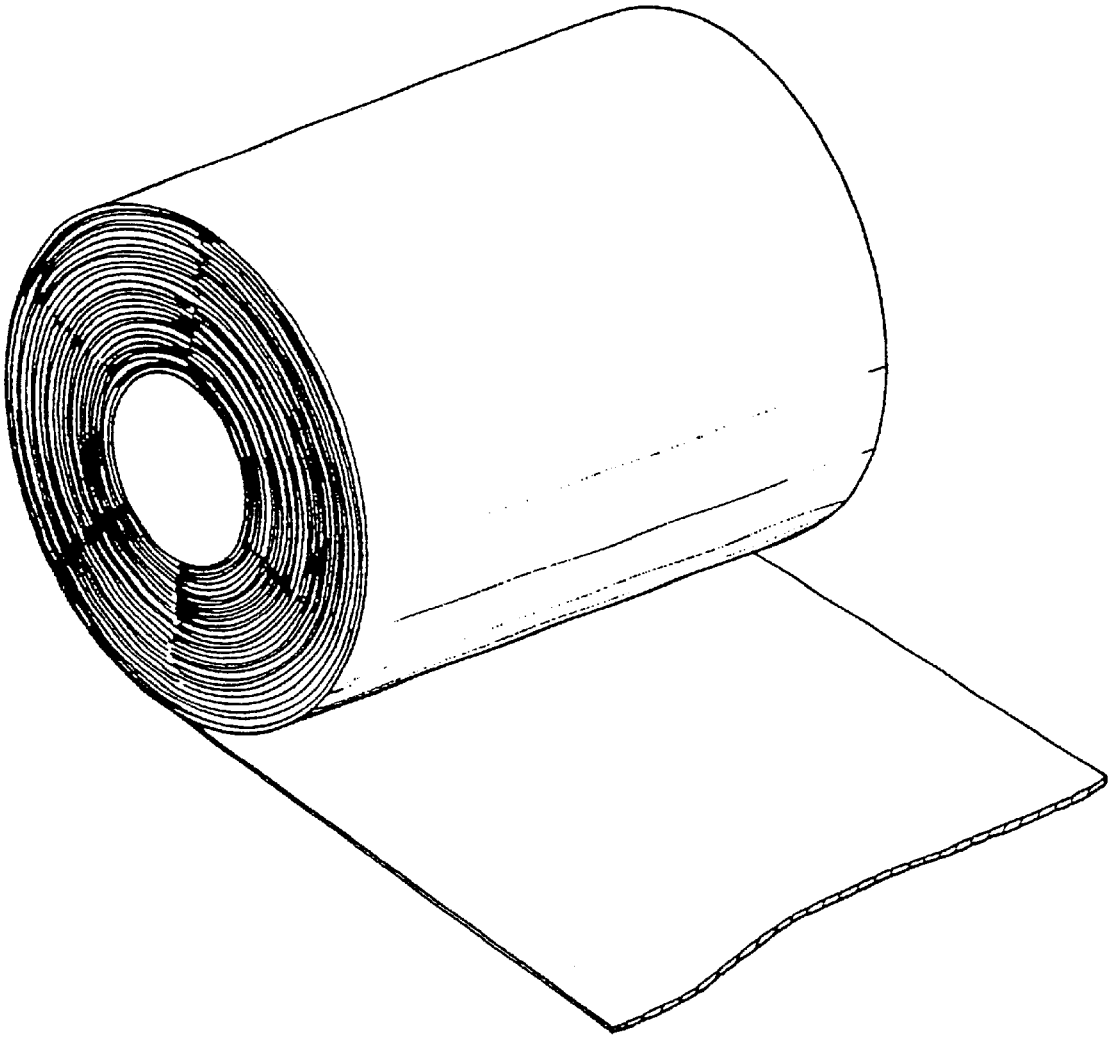

To prove the operational effect of this invention in detail, a series of embodiments are discussed in the following descriptions, and the results thereof are shown in FIGS. 13A and 13B.

Embodiment

FIG. 11 shows the cast result of the strip 240 in the case where the height $H_E$ of the edge dam 230 was varied. As noted in FIG. 11, the casting for the strip 240 of about 2 mm in thickness was performed under the rolling force of the rolls 220 of about 10 tons, the height $H_E$ of edge dam 230 was controlled to be positioned up to about 6 mm, and if performed under the rolling force of the rolls 220 of about 50 tons, the height $H_E$ Of edge dam 230 was controlled to be positioned up to about 10 mm. The strip 240, for which the position of the edge dam 230 was controlled according to this invention, has a quality edge and the abrasion of the edge dam 230 was greatly reduced.

The casting for the strip 240 of about 2 mm in thickness was performed under the rolling force of the rolls 220 of about 50 tons. FIG. 13A shows the edge faces of the strip 240 when the height $H_E$ of edge dam 230 was positioned up to about 0 mm according to prior art and FIG. 13B shows the edge faces of the strip 240 when the height $H_E$ of edge dam 230 was positioned up to about 10 mm according to this invention.

When the height $H_E$ of edge dam 230 was positioned on the roll nip point 222, that is, up to about 0 mm according to the conventional device and method, solidified steel particles were roughly attached on the edges of the strip 240 or the edges of the strip 240 were torn. However, when the height $H_E$ of edge dam 230 was positioned to correspond with the height $H_s$ of solidification point 260, that is, up to about 10 mm according to this invention, the states of edges of the strip 240 are good and valid.

As clearly discussed so far, an edge dam position control method and device in a twin roll strip casting process in this invention can control the height of an edge dam to correspond with the height of a solidification point, to thereby minimize the force applied to the edge dam from the melt. Thus, the degree of abrasion of the edge dam can be minimized. In addition, an edge dam position control method and device in a twin roll strip casting process in this invention can efficiently prevent the leakage of the melt. This is because a backward movement of the edge dam is not generated even by the application of a slight force, to ensure a good quality of the strip.

It will be apparent to those skilled in the art that various modifications and variations can be made in an edge dam position control method and device in a twin roll strip casting process of the present invention without departing from the spirit or scope of the invention. Thus, it is intended that the present invention cover the modifications and variations of this invention, provided they come within the scope of the appended claims and their equivalents.

What is claimed is:

1. An edge dam position control method in a twin roll strip casting process for controlling the position of an edge dam to improve the quality of strip, said method comprising the steps of:

calculating the position of a solidification point to allotting force of twin rolls;

measuring the rolling force of twin rolls upon casting by means of a load cell;

determining whether the position of the solidification point of the measured rolling force of the twin rolls corresponds to a height of the bottom of the edge dam; and moving the edge dam to the position where the height of the bottom of said edge dam corresponds to the position of the solidification point of the measured rolling force of the rolls.

2. The method according to claim 1, wherein the step of calculating the position is comprised of the steps of:

calculating the position of the solidification point to a reduction ratio of the twin rolls; and calculating the rolling force of the twin rolls to the reduction ratio of the twin rolls.

3. The method according to claim 2, wherein the step of calculating the position of the solidification point to the reduction ratio of the twin rolls is to obtain the reduction ratio of the twin rolls by substituting the following expressions (1) and (2) for the following expression (3), and calculating the position of the solidification point:

$$\text{Reduction Ratio} = \frac{(G - G_o)}{G} \times 100 \tag{1}$$

$$G = G_o + D(1 - \cos\alpha),\ \alpha = \sin^{-1}\left(\frac{2H_s}{D}\right) \tag{2}$$

-continued $$\text{Reduction Ratio} = \frac{D\left(1-\cos\cdot\sin^{-1}\left(\frac{2H_s}{D}\right)\right)}{G_o \div D\left(1-\cos\cdot\sin^{-1}\left(\frac{2H_s}{D}\right)\right)} \times 100 \quad (3)$$

wherein, the variable 'G' represents a gap between the twin rolls at the solidification point, '$G_o$' an initial roll gap between the twin rolls at a roll nip point, 'D' the diameter of each roll, '$H_s$' the height up to the solidification point from the roll nip point, and 'α' an angle between the roll nip point and the solidification point, based upon the center of each roll.

4. The method according to claim 2, wherein the step of calculating the rolling force of the twin rolls to the reduction ratio of the twin rolls is to obtain the relationship between the rolling force of the twin rolls and the reduction ratio of the twin rolls by substituting the following expressions (5) to (8) for the following expression (4):

$$\text{Rolling Force} = K_m \cdot B_m \cdot L_d \cdot Q_p \quad (4)$$

wherein, the variable '$K_m$' designates mean hot deformation resistance (kg/mm$^2$), '$B_m$' mean strip width, '$L_d$' length (mm) of contact arc, and '$Q_p$' geometric factor; and $$L_d = \alpha\frac{D}{2} \quad (5)$$

$$Q_p = 0.8 + (0.45\gamma + 0.04)\sqrt{\frac{D}{2G} - 0.5} \quad (6)$$

$$\gamma = (G - G_o)/G = \text{strain} \quad (7)$$

$$K_m = f(C, \varepsilon, \dot{\varepsilon}, T) = C \cdot \varepsilon^n, \dot{\varepsilon}^m \cdot \exp\left(\frac{A}{T}\right) \quad (8)$$

wherein, the variable 'C' represents composition, the 'ε' strain, the 'ε' strain ratio, the 'T' temperature (°K), and in case of stainless steel 304, in a general hot rolling process, C=0.24, n=0.07, m=0.05 and A=5700, and in a strip continuous casting, C=0.2, n=0.07, m=0.05 and A=5300.

5. An edge dam position control device for improving the quality of a strip by controlling edge dam position in a twin roll strip casting process that casts strip from melt between rolls, being equipped with a pair of cast rolls and edge dams on both sides of the rolls, said device comprising:

an edge dam horizontal control unit having a first hydraulic cylinder which is adapted to be connected with the edge dam installed on both end faces of the rolls, respectively, to thereby allow the edge dam to maintain a predetermined force on an edge portion of both sides of the rolls, respectively, and having a horizontal position measuring sensor for measuring a horizontal displacement of the edge dam;

an edge dam vertical control unit disposed on the bottom surface of the edge dam horizontal control unit and having a second hydraulic cylinder which is adapted to ascend/descend the edge dam horizontal control unit and a vertical position measuring sensor to measure a vertical displacement of the edge dam to thereby control the upper and lower movement of the edge dam;

a first load cell for measuring the force of the edge dam which is exerted by a casting;

a second load cell for measuring the rolling force of the rolls applied to the strip which is exerted by casting and hot rolling; and a controller for moving the edge dam by using the edge dam vertical control unit: characterized in that said controller moves the edge dam to a position where the height of the bottom of the edge dam corresponds to the position of the solidification point of a pool of melt calculated on the basis of the edge dam position method of claim 1, whereby the force applied to the edge dam during casting is in all instances minimized, a degree of abrasion of the edge dam can be reduced, and leakage of melt can be efficiently prevented.

6. An edge dam position control method in a twin roll strip casting process for controlling the position of an edge dam to improve the quality of strip, said method comprising the steps of:

calculating the position of a solidification point to a rolling force of twin rolls;

measuring the rolling force of twin rolls upon casting by means of a load cell;

determining whether the position of the solidification point of the measured rolling force of the twin rolls corresponds to a height of the bottom of the edge dam; and moving the edge dam to the position where the height of the bottom of said edge dam corresponds to the position of the solidification point of the measured rolling force of the rolls, wherein the step of calculating the position is comprised of the steps of:

calculating the position of the solidification point to a reduction ratio of the twin rolls and calculating the rolling force of the twin rolls to the reduction ratio of the twin rolls by substituting the following expressions (5) to (8) for the following expression (4):

$$\text{Rolling Force} = K_m \cdot B_m \cdot L_d \cdot Q_p \quad (4)$$

wherein, the variable '$K_m$' designates mean hot deformation resistance (kg/mm$^2$), '$B_m$' mean strip width, '$L_d$' length (mm) of contact arc, and '$Q_p$' geometric factor; and $$L_d = \alpha\frac{D}{2} \quad (5)$$

$$Q_p = 0.8 + (0.45\gamma + 0.04)\sqrt{\frac{D}{2G} - 0.5} \quad (6)$$

$$\gamma = (G - G_o)/G = \text{strain} \quad (7)$$

$$K_m = f(C, \varepsilon, \dot{\varepsilon}, T) = C \cdot \varepsilon^n, \dot{\varepsilon}^m \cdot \exp\left(\frac{A}{T}\right) \quad (8)$$

wherein, the variable 'C' represents composition, the 'ε' strain, the 'ε' strain ratio, the 'T' temperature (°K), and in case of stainless steel 304, in a general hot rolling process, C=0.24, n=0.07, m=0.05 and A=5700, and in a strip continuous casting, C=0.2, n=0.07, m=0.05 A=5300.

* * * * *

UNITED STATES PATENT AND TRADEMARK OFFICE

CERTIFICATE OF CORRECTION

PATENT NO. : 6,296,046 B1
DATED : October 2, 2001
INVENTOR(S) : Seong In Jeong et al.

It is certified that error appears in the above-identified patent and that said Letters Patent is hereby corrected as shown below:

Title page,
Item [22], PCT Filed: "Oct. 21, 1998" should read -- Dec. 31, 1998 --.

Column 1,
Line 53, after "the bottom" insert -- 232 --.

Column 2,
Line 23, "reduce the degree" should read -- reduce a degree --.
Line 51, "having a firs." should read -- having a first --.

Column 3,
Line 4, "a controller For" should read -- a controller for --.
Line 16, "in the drawings" should read -- In the drawings --.
Line 48, "rolls In the" should read -- rolls in the --.
Line 51, "results oft the" should read -- results of the --.

Column 4,
Line 66, before "the load" insert -- by --.

Column 5,
Line 35, "position of: the" should read -- position of the --.
Line 42, "one of important" should read -- one of several important --.

Column 6,
Line 8, "diagrammiatized" should read -- diagrammatized --.
Line 11, after "bottom" insert -- 232 --.
Line 11, after "edge dam" insert -- 230 --.
Line 24, after "bottom" insert -- 232 --.
Line 47, "melt 207 is leaks" should read -- melt 207 leaks --.
Line 55, after "height" insert -- $H_s$ --.

UNITED STATES PATENT AND TRADEMARK OFFICE

CERTIFICATE OF CORRECTION

PATENT NO. : 6,296,046 B1
DATED : October 2, 2001
INVENTOR(S) : Seong In Jeong et al.

It is certified that error appears in the above-identified patent and that said Letters Patent is hereby corrected as shown below:

Column 7,
Line 14, "force o: the" should read -- force of the --.
Line 29, in equation (2), "$G=G_o + Dx$" should read -- $G=G_o + D$ --.
Line 29, in equation (2), "$2xH_s$" should read -- $2H_s$ --.
Line 57, "to find out" should read -- to find --.

Column 8,
Line 1, "rolling, force" should read -- rolling force --.
Line 5, in equation (4), $L_a$" should read -- $L_d$ --.
Line 38, "diameters 0o" should read -- diameters of --.
Lines 40-41, "and a stainless steel made of cast." should read -- and a cast stainless steel is made. --
Line 53, "of solidification point" should read -- of the solidification point --.
Line 60, "the height of" should read -- the height $H_s$ of --.
Line 60, after "260" delete Hs".
Line 61, after bottom end" insert -- 232 --.

Column 9,
Line 36, after "bottom" insert -- 232 --.
Line 52, "Of edge dam" should read -- of edge dam --.

Column 10,
Lines 35-36, "allotting force" should read -- a rolling force --.

Column 12,
Line 8, "is in all instances minimized" should read -- is minimized --.
Line 9, "can be" should read -- is --.

UNITED STATES PATENT AND TRADEMARK OFFICE

CERTIFICATE OF CORRECTION

PATENT NO. : 6,296,046 B1
DATED : October 2, 2001
INVENTOR(S) : Seong In Jeong et al.

It is certified that error appears in the above-identified patent and that said Letters Patent is hereby corrected as shown below:

Column 12 con'td.
Line 10, "can be" should read -- is --.
Line 59, "the 'ε' strain ratio" should read -- the 'ε' strain ratio --.
Line 63, after "m=0.05" insert -- and --.

Signed and Sealed this

Second Day of July, 2002

*Attest:*

*Attesting Officer*

JAMES E. ROGAN
*Director of the United States Patent and Trademark Office*